US007914630B2

(12) United States Patent
Dessis et al.

(10) Patent No.: US 7,914,630 B2
(45) Date of Patent: Mar. 29, 2011

(54) METHOD FOR PRODUCING MAT-SURFACED AUSTENITIC STAINLESS STEEL STRIPS

(75) Inventors: Arnaud Dessis, Ugine (FR); Henri Giraud, Gueugnon (FR); Caroline Dhondt, Mont Bernanchon (FR)

(73) Assignee: Ugine & Alz France, Saint Denis (FR)

( * ) Notice: Subject to any disclaimer, the term of this patent is extended or adjusted under 35 U.S.C. 154(b) by 1002 days.

(21) Appl. No.: 10/593,971

(22) PCT Filed: Mar. 9, 2005

(86) PCT No.: PCT/FR2005/000556

§ 371 (c)(1),
(2), (4) Date: Mar. 14, 2007

(87) PCT Pub. No.: WO2005/102548

PCT Pub. Date: Nov. 3, 2005

(65) Prior Publication Data

US 2007/0181230 A1 Aug. 9, 2007

(30) Foreign Application Priority Data

Mar. 25, 2004 (FR) ..... 04 03106

(51) Int. Cl.
*C21D 1/10* (2006.01)
*C21D 1/68* (2006.01)
*C21D 6/00* (2006.01)

(52) U.S. Cl. ..... 148/575; 148/606; 148/611

(58) Field of Classification Search ..... 148/575, 148/606, 611; *B21B 45/06*
See application file for complete search history.

(56) References Cited

U.S. PATENT DOCUMENTS

| | | | | |
|---|---|---|---|---|
| 2,955,062 | A | 10/1960 | Conley et al. | |
| 4,744,837 | A * | 5/1988 | Brockington et al. | 148/277 |
| 5,702,539 | A * | 12/1997 | Schoen et al. | 148/111 |
| 5,820,704 | A | 10/1998 | Veyer et al. | |
| 5,851,304 | A | 12/1998 | Giraud et al. | |
| 5,976,282 | A * | 11/1999 | Fukuda et al. | 148/606 |
| 6,109,336 | A * | 8/2000 | Pronk et al. | 164/476 |
| 2004/0079398 | A1 * | 4/2004 | Koza et al. | 134/41 |

FOREIGN PATENT DOCUMENTS

| | | | |
|---|---|---|---|
| GB | 1 109 844 | | 4/1968 |
| JP | 58 034180 | | 2/1983 |
| JP | 59 140390 | | 8/1984 |
| JP | 08-269754 | * | 10/1996 |
| JP | 08269754 A | * | 10/1996 |
| JP | 10 280087 | | 10/1998 |
| JP | 2003342798 A | * | 12/2003 |

* cited by examiner

*Primary Examiner* — Jessica L Ward
*Assistant Examiner* — Alexander Polyansky
(74) *Attorney, Agent, or Firm* — Oblon, Spivak, McClelland, Maier & Neustadt, L.L.P.

(57) ABSTRACT

The subject of the invention is a process for the continuous manufacture of an austenitic stainless steel strip having a dull surface appearance, consisting in subjecting an austenitic stainless steel strip to a heat treatment in a bright annealing furnace inside which an inert or reducing flushing gas circulates, which gas has a dew point above −15° C., and then in pickling the strip using a suitable acid pickling solution.

19 Claims, 3 Drawing Sheets

METHOD FOR PRODUCING MAT-SURFACED AUSTENITIC STAINLESS STEEL STRIPS

The present invention relates to a process for the continuous manufacture of an austenitic stainless steel strip having a dull surface appearance, of the annealed/pickled type.

Depending on the type of final heat treatment that an austenitic stainless steel strip undergoes, the austenitic stainless steel strip is given either a bright surface appearance or a dull surface appearance, according to the application for which the strip is intended. For the purpose of the present invention, the term "bright surface appearance" is understood to mean a surface having a brightness of greater than 40 and an arithmetic mean roughness Ra of less than 0.08 μm and the term "dull surface appearance" is understood to mean a surface having a brightness of less than 30 and an arithmetic mean roughness Ra of greater than 0.12 μm. According to the invention, the brightness corresponds to the surface reflectivity and is measured at an angle of 60°.

To obtain a bright surface appearance, austenitic stainless steel strip undergoes a heat treatment in a bright annealing furnace in which there is a reducing atmosphere. For this purpose, the strip runs through the furnace, which consists of an enclosure completely isolated from the external atmosphere, comprising three zones, namely a heating first zone, a temperature soak second zone and a cooling third zone, in which an inert or reducing gas circulates. This gas may be chosen for example from argon, hydrogen, nitrogen or a hydrogen/nitrogen mixture, and has a dew point between −65 and −45° C. After having been cold-rolled, the strip is heated in the first zone of the furnace to a temperature between 1050 and 1150° C. It is then maintained at this temperature in the second zone of the furnace for a time long enough to allow the steel to recrystallize. Finally, it is cooled in the third zone of the furnace down to a temperature of around 200° C. in order to avoid any reoxidation of the surface of the strip with the oxygen of the air when the strip leaves the furnace enclosure.

To obtain an austenitic stainless steel strip having a surface appearance of the annealed/pickled type, that is to say a dull surface appearance, the procedure is as follows. The strip, cold-rolled beforehand, undergoes continuous annealing at a temperature of around 1100° C., for about 1 minute, in a furnace whose atmosphere is oxidizing. The annealed strip then undergoes air cooling and/or forced cooling, by spraying it with water outside the furnace. Finally, it undergoes pickling in several pickling tanks containing solutions capable of removing the oxide layer that was formed on the surface of the strip during annealing.

Owing to the specialization of bright annealing and annealing/pickling installations, it is not always possible to immediately respond to a customer demand for austenitic stainless steel strip having a dull appearance. Consequently, there may in places be an overcapacity of bright-annealed austenitic stainless steel strip production.

The object of the present invention is therefore to provide a process that allows an austenitic stainless steel strip having undergone a heat treatment in a bright annealing furnace to be given a dull surface appearance, of the annealed/pickled type.

For this purpose, the subject of the invention is a process for the continuous manufacture of an austenitic stainless steel strip having a dull surface appearance, of the annealed/pickled type, comprising the steps consisting in:

subjecting a cold-rolled austenitic stainless steel strip to a heat treatment in a bright annealing furnace inside which a flushing gas chosen from inert or reducing gases, having a dew point above −15° C. circulates, said flushing gas optionally comprising less than 1% oxygen by volume or less than 1% air by volume, said heat treatment comprising a heating phase at a heating rate V1, a soak phase at a temperature T for a soak time M, followed by a cooling phase at a cooling rate V2, in order to obtain a strip covered with an oxide layer; and pickling the strip having undergone the heat treatment, using an acid pickling solution suitable for completely removing said oxide layer according to its thickness and its nature.

Figure 1:
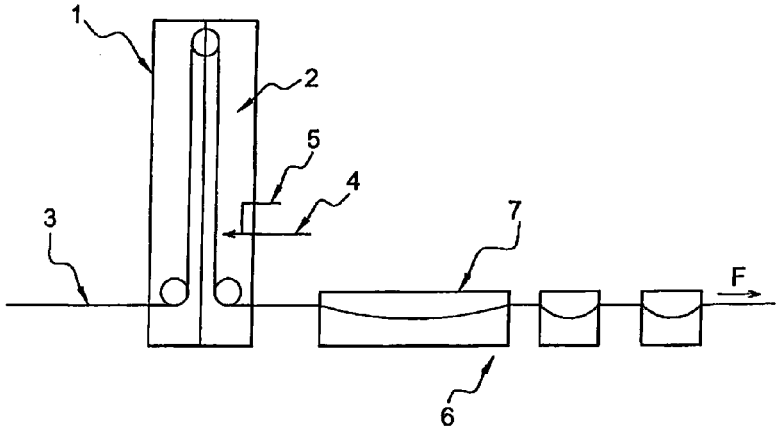
FIG. 1 shows a schematic view of an installation suitable for implementing an embodiment of the invention.

Before achieving the process according to the invention, the inventors had the idea of pickling austenitic stainless steel strip that had undergone bright annealing so as to give it a dull surface appearance, of the annealed/pickled type. However, the inventors realized that, by proceeding in this manner, it was not possible to obtain a visually satisfactory surface appearance.

The inventors have thus demonstrated that only the application of the conditions according to the invention, namely the soak in the enclosure of the bright annealing furnace, a dew point above −15° C., in order to form an oxide layer on the surface of the strip, followed by pickling in an appropriate pickling is solution, makes it possible to give the strip a dull surface appearance of the annealed/pickled type.

The process according to the invention may also have the following features:

The dew point of the flushing gas is between −10 and 30° C. and preferably between −5 and 10° C.;

the flushing gas is chosen from argon, hydrogen, nitrogen and mixtures thereof;

the heat treatment of the strip is carried out at a rate V1 of greater than 10° C./s, a soak temperature T between 1050 and 1150° C., a soak time M between 1 s and 120 s and said strip is cooled at a rate V2 of greater than 10° C./s down to a temperature of 200° C. or below;

the heat treatment is carried out using a resistance heating device and preferably using an induction heating device;

the pickling solution is chosen from aqueous solutions comprising nitric acid, hydrofluoric acid and/or sulphuric acid and preferably from aqueous solutions comprising hydrofluoric acid and nitric acid, and aqueous solutions comprising hydrofluoric acid and ferric ions $Fe^{3+}$;

the pickling solution is an aqueous solution containing 10 to 80 g/l, preferably 30 to 50 g/l, hydrofluoric acid and 60 to 140 g/l, preferably 80 to 120 g/l, nitric acid;

the pickling solution is an aqueous solution containing 5 to 100 g/l, preferably 30 to 80 g/l, hydrofluoric acid and 1 to 150 g/l, preferably 30 to 50 g/l, ferric ions;

the strip is either sprayed with the pickling solution or immersed in a pickling bath containing said pickling solution;

the temperature of the pickling solution is between 20 and 100° C., preferably between 50 and 80° C.; and the time during which the strip is in contact with the pickling solution is between 10 s and 2 min.

The features and advantages of the present invention will become more clearly apparent over the course of the following description, given by way of non-limiting example, with reference to appended FIG. 1 showing a schematic view of an installation that may be suitable for implementing the invention.

This installation comprises a bright annealing furnace 1, comprising a gastight enclosure 2 through which an austenitic stainless steel strip 3 runs, means 4 for introducing a flushing gas into the gastight enclosure, and means 5 for regulating the dew point of the flushing gas. After the bright annealing furnace 1, the installation comprises a pickling unit 6 that comprises at least one acid-resistant pickling tank 7 containing a pickling solution.

The gastight enclosure 2 comprises, in the run direction of the strip 3 indicated by the arrow F, three successive zones, namely a heating first zone, a temperature soak second zone and a cooling third zone. The heating first zone is equipped with powerful heating means (not shown) capable of rapidly heating the strip 3 at a heating rate V1, up to a temperature T1. The strip 3 is maintained at this temperature T1 in the second zone, for a soak time M, and is then cooled at a rate V2 down to a temperature T2, in the third zone.

According to the invention, to give an austenitic stainless steel strip 3 a dull surface appearance, it is necessary to carry out a heat treatment on the strip 3 in the enclosure 2 of the furnace 1, inside which a flushing gas having a dew point above −15° C. circulates, in order to obtain a strip 3 covered with an oxide layer, and then to pickle the heat-treated strip 3 using an acid pickling solution. The acid pickling solution is suitable for completely removing said oxide layer, according to its thickness and its nature.

Typically, the acid pickling solution will have a pH between 0 and 4.

The expression "gas having a dew point above −15° C." is understood to mean a gas whose moisture content is greater than 2000 ppm of water.

The flushing gas is chosen from inert or reducing gases, such as for example argon, hydrogen, nitrogen and mixtures thereof and may further include less than 1% by volume of oxygen or less than 1% by volume of air.

For this purpose, the strip 3 is made to undergo a heat treatment consisting of a recrystallization annealing operation carried out at a heating rate V1 of greater than 10° C./s, a soak temperature T1 between 1050 and 1150° C. and a soak time between 1 s and 120 s, followed by forced cooling at a rate V2 of greater than 10° C./s down to a temperature T2 of 200° C. or below.

By treating the strip 3 under the conditions according to the invention, namely with a dew point of greater than −15° C., the flushing gas circulating in the enclosure 2 is sufficiently oxidizing for a thin oxide layer to form on the surface of the strip 3. This thin oxide layer, the nature and the thickness of which vary according to the atmosphere within the enclosure 2, can be removed using the acid pickling solution having a pH between 0 and 4.

To modify the oxidizing power of the flushing gas, the amount of water present in the flushing gas is modified.

Preferably, the dew point is above −10° C. so as to form a sufficiently thick oxide layer, but below 30° C. so as to limit the thickness of the oxide layer. By limiting the thickness of the oxide layer, the amount of metal consumed by the oxidation is limited, but so is also the amount of acid solution needed for correctly pickling the surface of the strip 3, thereby avoiding excessive effluent reprocessing.

Advantageously, the dew point is between −5 and 10° C.

The addition of at least 1% by volume of oxygen or air into the flushing gas also makes it possible to modify the oxidizing power of the flushing gas. However, above 1% by volume, the flushing gas is too oxidizing and the thickness of the oxide layer formed on the surface of the strip becomes too great. Furthermore, above this value, the risks of an explosion in the enclosure 2 become considerable.

The recrystalization annealing of the strip 3 is carried out either by means of a resistance heating device or preferably an induction heating device.

This is because induction heating of the strip 3 is advantageous for the following reasons. Firstly, the treatment time for the strip 3 is very short compared with the treatment time using resistance heating. Secondly, the enclosure 2 of a treatment furnace for treating the strip by induction heating is much less voluminous than the enclosure 2 of a treatment furnace for resistance heating, and this makes it possible to modify the atmosphere within this enclosure 2 in a much shorter time, in accordance with industrial requirements.

The forced cooling of the strip 3 is carried out by injecting a gas having a temperature between the ambient temperature and 40° C. It is the gas contained in the enclosure 2 of the furnace 1 that is cooled by cooling means (not shown) and is then reinjected into the cooling zone of the enclosure 2.

To give a dull surface appearance to the strip 3 treated according to the invention in a bright annealing furnace, it is pickled using an acid pickling solution suitable for completely removing the oxide formed on the strip 3. The acid pickling solution is adapted to the nature and to the thickness of the oxide formed during the heat treatment. In general, the acid pickling solution has a pH between 0 and 4.

The pickling solution is chosen from aqueous solutions comprising nitric acid, hydrofluoric acid and/or sulphuric acid.

The preferred pickling solutions are aqueous solutions containing nitric acid, aqueous solutions comprising hydrofluoric and nitric acid, and aqueous solutions comprising hydrofluoric acid and ferric ions $Fe^{3+}$.

The pickling solution may be an aqueous solution containing 5 to 100 g/l, preferably 30 to 80 g/l, of hydrofluoric acid and 1 to 150 g/l, preferably 30 to 50 g/l, of ferric ions.

Below 5 g/l of hydrofluoric acid and below 1 g/l of ferric ions, the pickling and more particularly the etching of the grain boundaries on the steel surface by the solution are insufficient, and the dull surface appearance is not obtained. However, when the hydrofluoric acid concentration is above 100 g/l and the ferric ion concentration is above 150 g/l, the pickling will however be too great, with the consequence of excessive removal of steel from the surface of the strip 3, and a larger quantity of spent solution to be processed.

The inventors have shown that the best results were obtained by using, as pickling solution, an aqueous solution containing 10 to 80 g/l, preferably 30 to 50 g/l, of hydrofluoric acid and 60 to 140 g/l, preferably 80 to 120 g/l, of nitric acid.

Below 10 g/l of hydrofluoric acid and below 60 g/l of nitric acid, the pickling and more particularly the etching of the grain boundaries on the steel surface by the solution are insufficient, and the dull surface appearance is not obtained. However, when the hydrofluoric acid concentration is above 80 g/l and the nitric acid concentration is above 140 g/l, the pickling will however be too great, with the consequence of excessive removal of steel from the surface of the strip 3, and a larger quantity of spent solution to be reprocessed.

To pickle the strip 3, it is immersed in a pickling bath containing the pickling solution or it is sprayed with the pickling solution, taking care to ensure that the contact time during which the pickling solution is in contact with the strip 3 is between 10 s and 2 min.

If the contact time during which the pickling solution is in contact with the strip 3 is less than 10 s, there is insufficient etching of the grain boundaries and the dull appearance will not be obtained. However, if the contact time during which the pickling solution is in contact with the strip 3 is greater than 2 min, the pickling is so great that there is a risk of excessive dissolution of the steel strip 3.

The temperature of the pickling solution is between 20 and 100° C., preferably between 50 and 80° C. This is because if the temperature of the pickling solution is below 20° C., treatment times for the strip 3 are required that are not in accordance with industrial requirements, that is to say times of greater than about 2 min. However, too high a temperature, that is to say above 100° C., favours evaporation of the solution and also poses safety problems.

To pickle the strip 3 effectively, it is also possible to immerse it in an electrolytic pickling bath containing a solution comprising nitric acid or sulphuric acid. For this purpose, the applied current density should be greater than 5 A/dm$^2$, but preferably less than 30 A/dm$^2$. This is because when the current density is below 5 A/dm$^2$ there is insufficient pickling of the steel surface by the solution and the dull surface appearance is not obtained. However, when the current density is above 30 A/dm$^2$, the pickling is not carried out economically.

Figure 2:
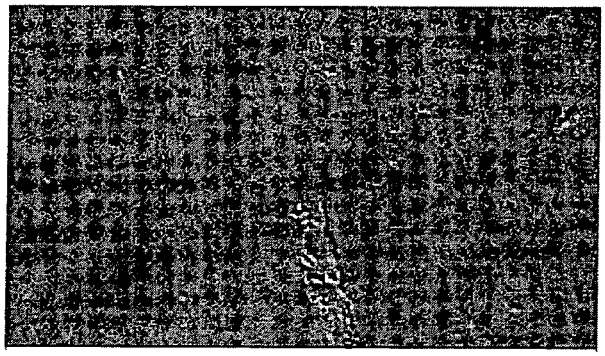
FIG. 2 shows the surface of an austenitic stainless steel that has undergone conventional bright annealing.
Figure 3:
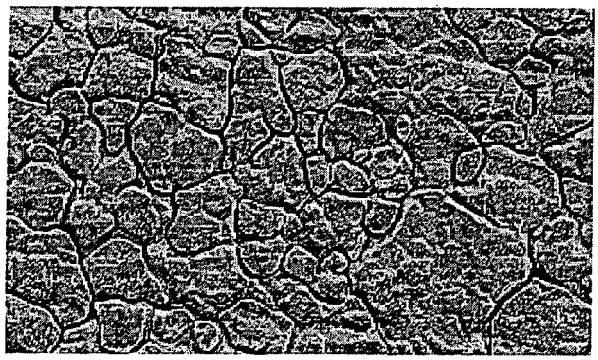
FIG. 3 shows the surface of an austenitic stainless steel that has undergone conventional annealing/pickling.
Figure 4:
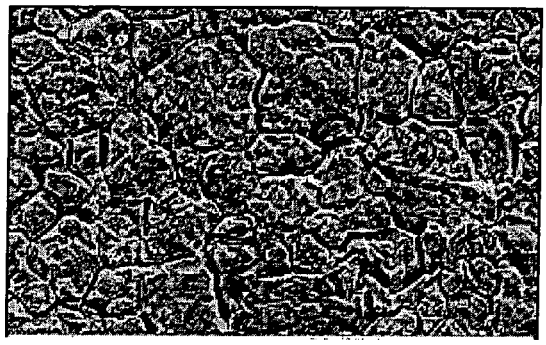
FIG. 4 shows an austenitic stainless steel exposed to heat treatment with a dew point of −5° C.
Figure 5:
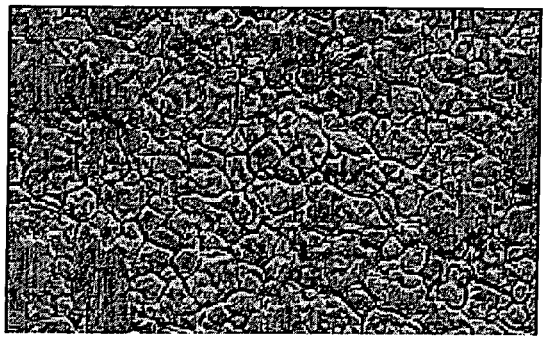
FIG. 5 shows an austenitic stainless steel exposed to heat treatment with a dew point of −5° C.

The invention will now be illustrated by examples given by way of non-limiting indication and with reference to the appended figures in which:

FIG. 2 is a photograph of the surface of an austenitic stainless steel strip that has undergone a conventional bright annealing operation;

FIG. 3 is a photograph of the surface of an austenitic stainless steel strip that has undergone a conventional treatment of the annealing/pickling type; and FIGS. 4 and 5 are photographs of austenitic stainless steel strips that have undergone a heat treatment according to the invention, with a dew point of −5° C. and successive pickling according to the invention with either an aqueous nitric acid/hydrofluoric acid solution (bath A) or an aqueous hydrofluoric acid/ferric iron solution (bath B), respectively.

All the trials were carried out using 0.5 mm thick strip manufactured from an austenitic stainless steel of AISI 304 grade.

1—Comparison Between the Surface Appearance Obtained by Conventional Bright Annealing and a Conventional Annealed/Pickled Surface Appearance Firstly, one of these strips having a surface appearance of the conventional bright annealing type and another of these strips having a surface appearance of the conventional annealed/pickled type, that is to say a dull surface appearance, were characterized so as to have a surface reference.

For this purpose, to obtain a surface appearance of the conventional bright annealing type, the strip in question, cold-rolled beforehand, is subjected to a heat treatment in the enclosure of a bright annealing furnace inside which a mixture of 25% nitrogen by volume and 75% hydrogen by volume, having a dew point of −50° C., circulates. The strip is heated at a heating rate of 10° C./s so as to bring it to 1100° C., and is maintained at this temperature for about 6 s before being cooled down to ambient temperature at a rate of 20° C./s.

To obtain a dull surface appearance employing the annealing/pickling process, a strip, cold-rolled beforehand, is heated at a heating rate of 10° C./s in order to bring it to a temperature of 1100° C. in a furnace that is not isolated from the external atmosphere. The strip is maintained at this temperature for about 5 s and then cooled down to ambient temperature at a rate of 20° C./s by an air quench followed by a water quench. Finally, the strip is pickled by immersing it in several electrolytic pickling baths and then in a bath based on hydrofluoric acid.

For each treated strip, the brightness in the length direction, denoted by $Br_L$, and the brightness in the transverse direction, denoted by $Br_T$ were measured. The brightness is a measure of the surface reflectivity at an angle of 60° —and also the various types of roughness below:

- total roughness $R_t$: difference in level between the highest peak and the deepest trough;
- roughness $R_p$: the largest projecting height of the roughness profile; and
- arithmetic mean roughness $R_a$: the mean of all the deviations of the roughness profile with respect to the mean line within a base length.

The results of the brightness and roughness measurements carried out on the bright annealed strip and on the annealed/pickled strip are given in Table 1 below:

| | | Bright annealing | Annealed/pickled |
|---|---|---|---|
| $Br_L$ | | 59 | 14.6 |
| $Br_T$ | | 56 | 12.6 |
| Roughness (μm) | $R_t$ | 1.22 | 1.78 |
| | $R_p$ | 0.26 | 0.43 |
| | $R_a$ | 0.07 | 0.15 |

2—Chemical Pickling of Strips that have Undergone Conventional Bright Annealing

Secondly, to show that the pickling of a bright-annealed strip does not allow it to be given the desired dull surface appearance, the inventors immersed specimens, taken from steel strip that has undergone conventional bright annealing as described above, into one of the pickling baths having the following characteristics:

- bath A: aqueous solution containing 40 g/l hydrofluoric acid and 100 g/l nitric acid, and having a pH 1;
- bath A': aqueous solution containing 40 g/l hydrofluoric acid and 150 g/l nitric acid, and having a pH of 0.7; and
- bath B: aqueous solution containing 40 g/l hydrofluoric acid and 30 g/l ferric ions, having a pH of 3.4.

All the baths had a constant temperature of 65° C.

After the specimens had been pickled, they were rinsed and then dried.

The brightness of the surface of each of the specimens was measured and the results are given in Table 2 below:

TABLE 2 brightness when the dew point is −45° C.

| | Bath A | Bath A' | Bath B |
|---|---|---|---|
| Cross brightness $Br_T$ | 53.5 | 53 | 58 |
| Observations regarding the surface | Bright appearance | Bright appearance | Bright appearance |

This table shows that none of the pickling solutions studied was capable of pickling an austenitic stainless steel having undergone a conventional annealing operation in a bright annealing furnace so as to give it a dull surface appearance.

3—Chemical Pickling of Strip having Undergone a Heat Treatment according to the Invention Thirdly, specimens taken from austenitic stainless steel strip of AISI 340 grade having undergone a heat treatment according to the invention in a bright annealing furnace were pickled.

For this purpose, a series of specimens were subjected to a heat treatment in the enclosure of a bright annealing furnace, inside which a mixture comprising 75% hydrogen by volume and 25% nitrogen by volume circulated, the treatment characteristics being as follows:

heating rate V1: 10° C./s;

soak temperature T: 1100° C.

soak time M: 6 s;

cooling rate down to ambient temperature: 20° C./s, and the dew point of which mixture was −20° C., −10° C., −5° C., and +4° C.

Next, each of the specimens of the series was subjected to a pickling operation by immersing them either in pickling bath A for 16 s or in pickling bath B for 90 s.

Both baths had a constant temperature of 65° C.

After the specimens had been pickled, they were rinsed and dried, and the brightness in the length direction, the brightness in the transverse direction, the total roughness, the roughness $R_p$ and the arithmetic mean roughness of each of the specimens treated were measured. The following tables give all the measurements carried out as a function of the dew points of the gas flushing the enclosure of the furnace during the treatment:

TABLE 3 brightness and roughness when the dew point was −20° C.

| | Bath A | Bath B |
|---|---|---|
| $Br_L$ | 3.3 | 12 |
| $Br_T$ | 2.7 | 9 |
| $R_t$ (μm) | 3.01 | 2.01 |
| $R_p$ (μm) | 1.21 | 0.65 |
| $R_a$ (μm) | 0.33 | 0.24 |
| Observations | Surface appearance similar to that expected, but substantial oxide remains | Insufficient pickling |

TABLE 4 brightness and roughness when the dew point was −10° C.

| | Bath A | Bath B |
|---|---|---|
| $Br_L$ | 2.7 | 13 |
| $Br_T$ | 2.4 | 12 |
| $R_t$ (μm) | 2.76 | 1.73 |
| $R_p$ (μm) | 1.53 | 0.63 |
| $R_a$ (μm) | 0.29 | 0.15 |
| Observations | Satisfactory result: good overall dull appearance | Good overall dull appearance |

TABLE 5 brightness and roughness when the dew point was −5° C.

| | Bath A | Bath B |
|---|---|---|
| $Br_L$ | 2.2 | 12.2 |
| $Br_T$ | 1.8 | 9.7 |
| $R_t$ (μm) | 2.54 | 1.92 |
| $R_p$ (μm) | 1.19 | 0.63 |

TABLE 5-continued brightness and roughness when the dew point was −5° C.

| | Bath A | Bath B |
|---|---|---|
| $R_a$ (μm) | 0.33 | 0.23 |
| Observations | Very satisfactory result: pickled surface and dull appearance | Good overall dull appearance |

TABLE 6 brightness and roughness when the dew point was +4° C.

| | Bath A | Bath B |
|---|---|---|
| $Br_L$ | 2.4 | 9.0 |
| $Br_T$ | 2.1 | 7.6 |
| $R_t$ (μm) | 2.08 | 1.91 |
| $R_p$ (μm) | 0.62 | 0.70 |
| $R_a$ (μm) | 0.16 | 0.18 |
| Observations | Very satisfactory result: pickled surface and dull appearance | Good overall dull appearance |

From the results contained in points 2 and 3, it is clearly apparent that pickling an austenitic stainless steel strip by means of a pickling solution does not give the strip that has undergone a heat treatment in a bright annealing furnace under the standard conditions a dull surface appearance. This is because only by applying the conditions according to the invention, namely a soak in the enclosure of the bright annealing furnace with a dew point above −15° C. followed by pickling in a pickling solution having a pH between 0 and 4, is it possible to give the strip a dull surface appearance of the annealed/pickled type.

The invention claimed is:

1. A process for the continuous manufacture of an austenitic stainless steel strip having a dull surface appearance with a brightness of less than 30 and an arithmetic mean roughness Ra of greater than 0.12 μm, of the annealed/pickled type, the process comprising:

subjecting a cold-rolled austenitic stainless steel strip to a heat treatment in a bright annealing furnace inside which a flushing gas chosen from inert or reducing gases and having a dew point above −5° C. circulates, said flushing gas comprising less than 1% oxygen by volume and less than 1% air by volume, said heat treatment comprising a heating phase at a heating rate V1, a soak phase at a temperature T for a soak time M, followed by a cooling phase at a cooling rate V2, in order to obtain a strip covered with an oxide layer; and pickling the strip covered with an oxide layer using an acid pickling solution capable of completely removing said oxide layer according to its thickness and its nature.

2. The process according to claim 1, wherein the dew point of said flushing gas is from above −5° C. to 30° C.

3. The process according to claim 1, wherein the dew point of said flushing gas is between −5 and 10° C.

4. The process according to claim 1, wherein said flushing gas comprises at least one gas selected from the group consisting of argon, hydrogen, and nitrogen.

5. The process according to claim 1, wherein the heat treatment of the cold-rolled austenitic stainless steel strip is carried out at a rate V1 of greater than 10° C./s, a soak temperature T between 1050 and 1150° C., and a soak time M between 1 s and 120 s, and in the cooling phase said strip is cooled at a rate V2 of greater than 10° C./s down to a temperature of 200° C. or below.

6. The process according to claim 1, wherein the heat treatment of the cold-rolled austenitic stainless steel strip is carried out using an induction heating device.

7. The process according to claim 1, wherein the heat treatment of the cold-rolled austenitic stainless steel strip is carried out using a resistance heating device.

8. The process according to claim 1, wherein the acid pickling solution is an aqueous solution comprising at least one acid selected from the group consisting of nitric acid, hydrofluoric acid and sulfuric acid.

9. The process according to claim 8, wherein the aqueous solution comprises hydrofluoric acid and nitric acid, or the aqueous solution comprises hydrofluoric acid and further comprises ferric ions $Fe^{3+}$.

10. The process according to claim 9, wherein the aqueous solution comprises 10 to 80 g/l hydrofluoric acid and 60 to 140 g/l nitric acid.

11. The process according to claim 10, wherein the aqueous solution comprises 30 to 50 g/l hydrofluoric acid and 80 to 120 g/l nitric acid.

12. The process according to claim 9, wherein the aqueous solution comprises 5 to 100 g/l hydrofluoric acid and 1 to 150 g/l ferric ions.

13. The process according to claim 12, wherein the aqueous solution comprises 30 to 80 g/l hydrofluoric acid and 30 to 50 g/l ferric ions.

14. The process according to claim 1, wherein in the pickling the strip covered with an oxide layer is sprayed with the acid pickling solution.

15. The process according to claim 1, wherein in the pickling the strip covered with an oxide layer is immersed in a pickling bath containing the acid pickling solution.

16. The process according to claim 1, wherein the temperature of the acid pickling solution is between 20 and 100° C.

17. The process according to claim 16, wherein the temperature of the acid pickling solution is between 50 and 80° C.

18. The process according to claim 1, wherein the time during which the strip is in contact with the acid pickling solution is between 10 s and 2 min.

19. The process according to claim 1, wherein in the pickling the oxide layer is completely removed from the strip covered with an oxide layer.

* * * * *